US007248224B2

(12) United States Patent
Yuanzhu

(10) Patent No.: US 7,248,224 B2
(45) Date of Patent: Jul. 24, 2007

(54) ANTENNA DEVICE HAVING RADIATION CHARACTERISTICS SUITABLE FOR ULTRAWIDEBAND COMMUNICATIONS

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 34 days.

(21) Appl. No.: 11/314,578

(22) Filed: Dec. 21, 2005

(65) Prior Publication Data

US 2006/0132362 A1 Jun. 22, 2006

(30) Foreign Application Priority Data

Dec. 22, 2004 (JP) ..... 2004-370417

(51) Int. Cl.
*H01Q 1/38* (2006.01)

(52) U.S. Cl. ..... 343/700 MS; 343/767

(58) Field of Classification Search ..... 343/700 MS, 343/725, 727, 767, 770, 895
See application file for complete search history.

(56) References Cited

U.S. PATENT DOCUMENTS 6,664,931 B1 * 12/2003 Nguyen et al. ..... 343/767
6,906,669 B2 * 6/2005 Sabet et al. ..... 343/700 MS
2003/0043083 A1 * 3/2003 Huang ..... 343/767
2004/0104851 A1 * 6/2004 Kadambi et al. .... 343/700 MS

FOREIGN PATENT DOCUMENTS

JP 2003-133838 5/2003

* cited by examiner

*Primary Examiner*—Tho Phan
(74) *Attorney, Agent, or Firm*—Brinks Hofer Gilson & Lione

(57) ABSTRACT

An antenna device includes a plate-shaped conductor and a radiating conductor that extends outward from an end portion of the conductor and has a length corresponding to a quarter wavelength of a first frequency. A strip-shaped slot portion formed by removing a part of the plate-shaped conductor extending inward from the end portion has a length corresponding to a quarter wavelength of a second frequency. A feed portion is perpendicular to the slot portion and crosses over the slot portion. The feed portion feeds the same signals to the slot portion and the radiating conductor.

12 Claims, 7 Drawing Sheets

ANTENNA DEVICE HAVING RADIATION CHARACTERISTICS SUITABLE FOR ULTRAWIDEBAND COMMUNICATIONS

BACKGROUND OF THE INVENTION

1. Field of the Invention

The present invention relates to an antenna device, having improved wideband frequency characteristics, suitable for being used in a communication system requiring wideband characteristics, such as ultrawideband (UWB) communications where impulses are directly used without carriers in an electrical manner.

2. Description of the Related Art

Conventionally, there has been known a technique for widening a band in wireless communications using carriers, which is shown in FIG. 8.

Referring to FIG. 8, an antenna device according to the related art is configured such that two plate-shaped radiating conductors 53 and 54 are provided on a surface of a plate-shaped dielectric 52 provided to stand on a ground plane 51, the two plate-shaped radiating conductors 53 and 54 being vertically provided parallel to each other and having slightly different lengths from each other, one end of the radiating conductor 53 facing the ground plane 51 is connected to a feed line 55 such as a coaxial cable, one end of the radiating conductor 54 is connected to the ground plane 51, and the radiating conductors 53 and 54 are coupled through a capacitor 56 that adjusts an impedance.

Further, when carrier signals are fed through the feed line 55, the two radiating conductors 53 and 54 resonate at different frequencies so as to radiate electric waves, respectively, because the radiating conductors 53 and 54 are coupled to each other and have slightly different lengths from each other even though the signals having the same frequency are fed thereto. Thus, as shown by a dotted line in FIG. 7, it is possible to widen the band (for example, see JP-A-2003-133838).

However, in a case in which the lengths of the radiating conductors 53 and 54 are greatly different in order to widen the band even more in the conventional antenna device, the radiating conductors 53 and 54 are not properly coupled to each other, and the resonance of the radiating conductor 54 becomes weak because the wavelength of the carrier signal fed thereto and the length of the radiating conductor 54 are greatly different from each other, which makes it impossible to widen the band in a bilaterally symmetrical manner.

Further, when the length of the radiating conductor 54 is set to be extremely different from the wavelength of the carrier signal fed thereto in order to widen the band, the radiating conductor 54 cannot resonate.

Therefore, even though various design conditions, such as a coupling condition, are optimized in the antenna device according to the related art, only several percent of a band can be widened as compared with the band which can be widened when only one radiating conductor is used.

Furthermore, even though conditions, such as the length difference between two radiating conductors, the coupling condition due to the arrangement gap, or the capacitance of a capacitor that adjusts the impedance, are set in the antenna device according to the related art, it is not possible to perform the radiation in a frequency band required for the ultrawideband communications.

SUMMARY OF THE INVENTION

The invention is designed to solve the above problems, and it is an object of the invention to provide an antenna device which covers a wideband, has improved antenna characteristics, and has a small size.

In order to achieve the above object, according to an aspect of the invention, an antenna device includes: a plate-shaped conductor; a radiating conductor that extends outward from an end portion of the conductor and has a length corresponding to a quarter wavelength of a first frequency; a strip-shaped slot portion that is formed by removing a part of the conductor extending inward from the vicinity of the end portion from which the radiating conductor extends and has a length corresponding to a quarter wavelength of a second frequency, the second frequency being different from the first frequency; and a feed portion that is disposed to be perpendicular to the slot portion and to cross over the slot portion and that feeds the same signals to the slot portion and the radiating conductor. A polarization plane of a radiating electric field radiating from the radiating conductor and a polarization plane of a radiating electric field radiating from the slot portion are disposed to be perpendicular to each other.

In the antenna device, it is preferable that the radiating conductor be formed in a meandering shape.

Further, in the antenna device according to the aspect of the invention, preferably, the radiating conductor is bent along the longitudinal direction of the slot portion with the end portion of the conductor as a reference line in a state in which the radiating conductor and the conductor are on the same plane, and the radiating conductor is disposed between the conductor and a location closest to the conductor.

Furthermore, in the antenna device, preferably, the radiating conductor extends from the conductor on the same plane as the conductor.

Furthermore, in the antenna device, preferably, the radiating conductor is disposed vertically with respect to the conductor.

Furthermore, in the antenna device, preferably, the conductor and the radiating conductor are formed by using one metal plate.

Furthermore, in the antenna device, preferably, the feed portion is formed by using the one metal plate formed with the conductor and the radiating conductor.

Furthermore, in the antenna device, preferably, the plate-shaped conductor is mounted with a circuit board formed with at least an amplifying circuit, one end of the feed portion is connected to the amplifying circuit, and the other end of the feed portion is connected to the conductor in the vicinity of the slot portion.

Furthermore, in the antenna device, preferably, a dielectric substrate one surface of which being formed with a conductive pattern is further included, and the conductor and the radiating conductor are formed by the conductive pattern.

Furthermore, in the antenna device, preferably, the dielectric substrate is formed by using a flexible substrate that can be bent.

Furthermore, in the antenna device, preferably, a wiring pattern and at least an amplifying circuit are provided at the other surface side of the dielectric substrate, the feed portion is formed by the wiring pattern, and one end of the feed portion is connected to the amplifying circuit and the other end of the feed portion is connected to the conductor through a through hole.

Furthermore, in the antenna device, preferably, the first frequency radiating from the radiating conductor is lower than the second frequency radiating from the slot portion.

DESCRIPTION OF THE PREFERRED EMBODIMENT

Hereinafter, preferred embodiments of the invention will be described in detail with reference to the accompanying drawings.

Figure 1:
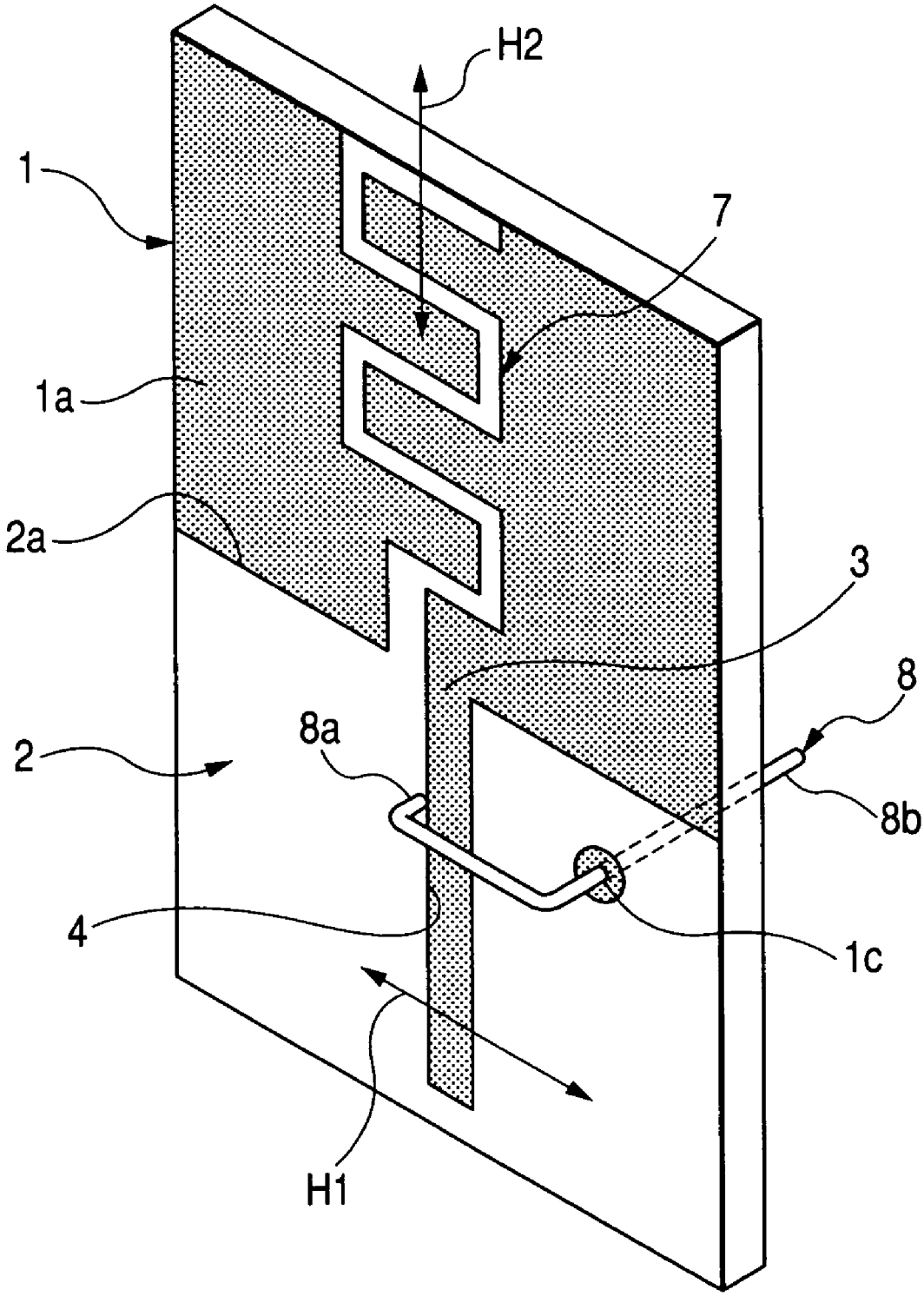
FIG. 1 is a perspective view illustrating an antenna device according to a first embodiment of the invention.
Figure 2:
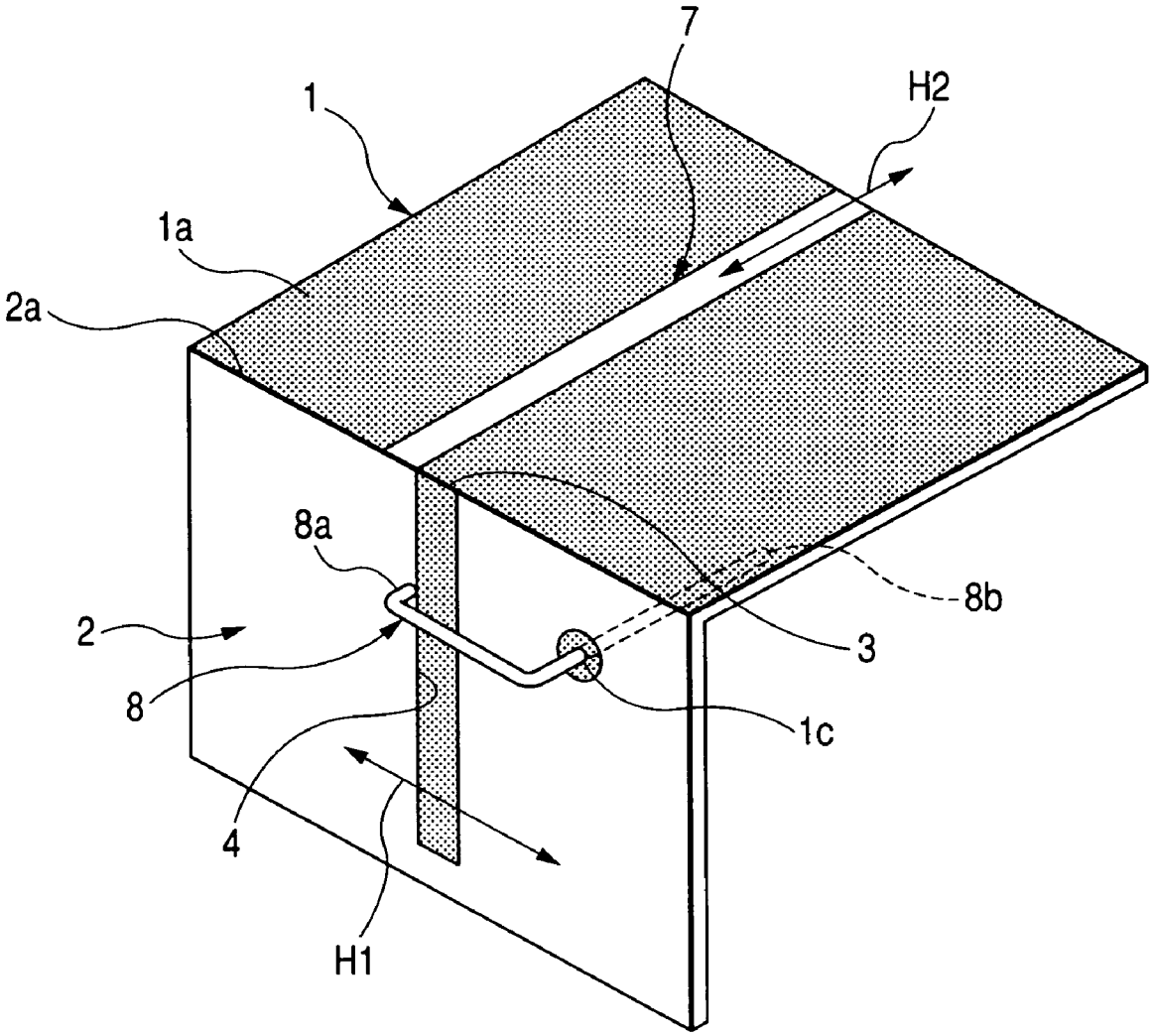
FIG. 2 is a perspective view illustrating an antenna device according to a second embodiment of the invention.
Figure 3:
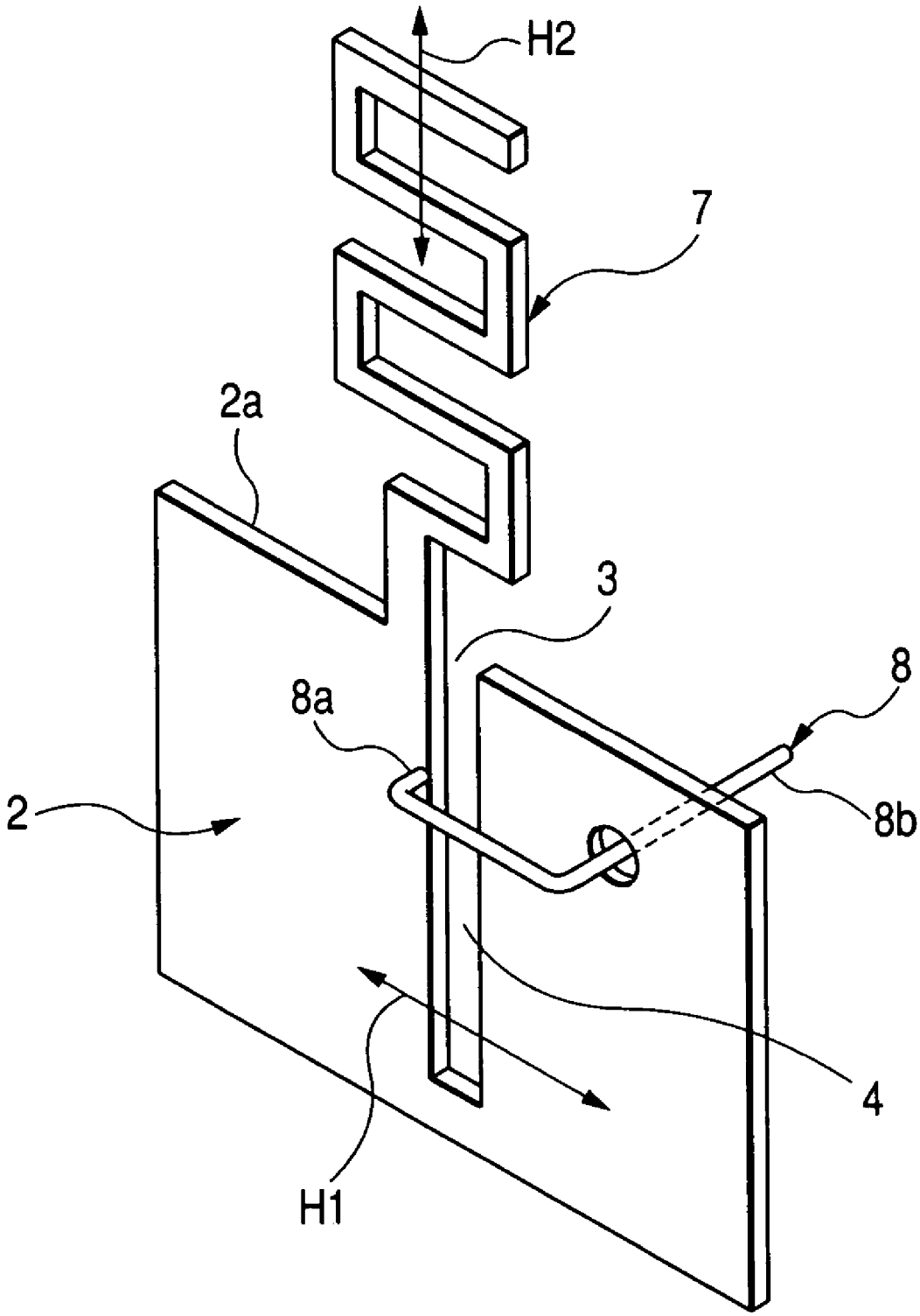
FIG. 3 is a perspective view illustrating an antenna device according to a third embodiment of the invention.
Figure 4:
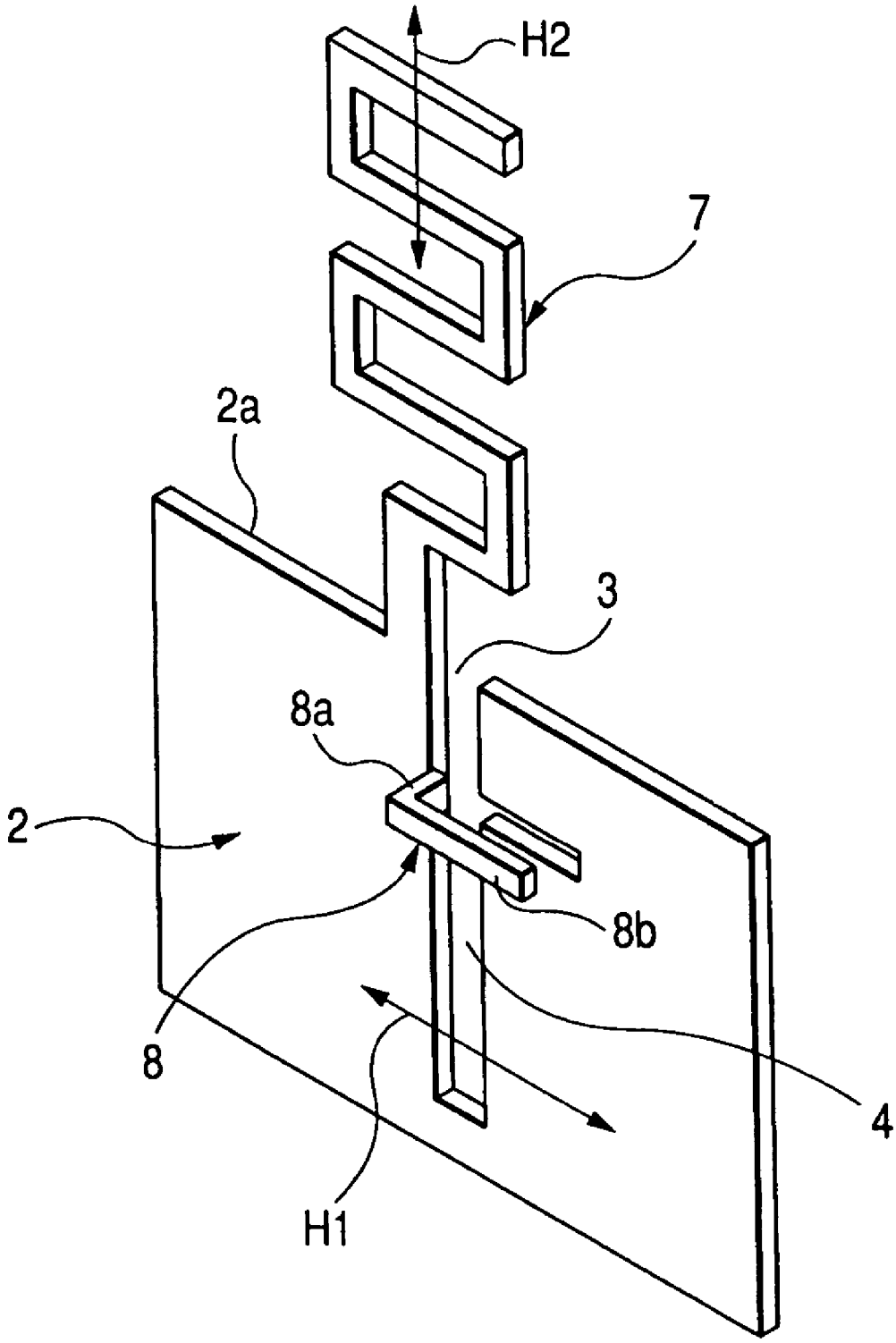
FIG. 4 is a perspective view illustrating an antenna device according to a fourth embodiment of the invention.
Figure 5:
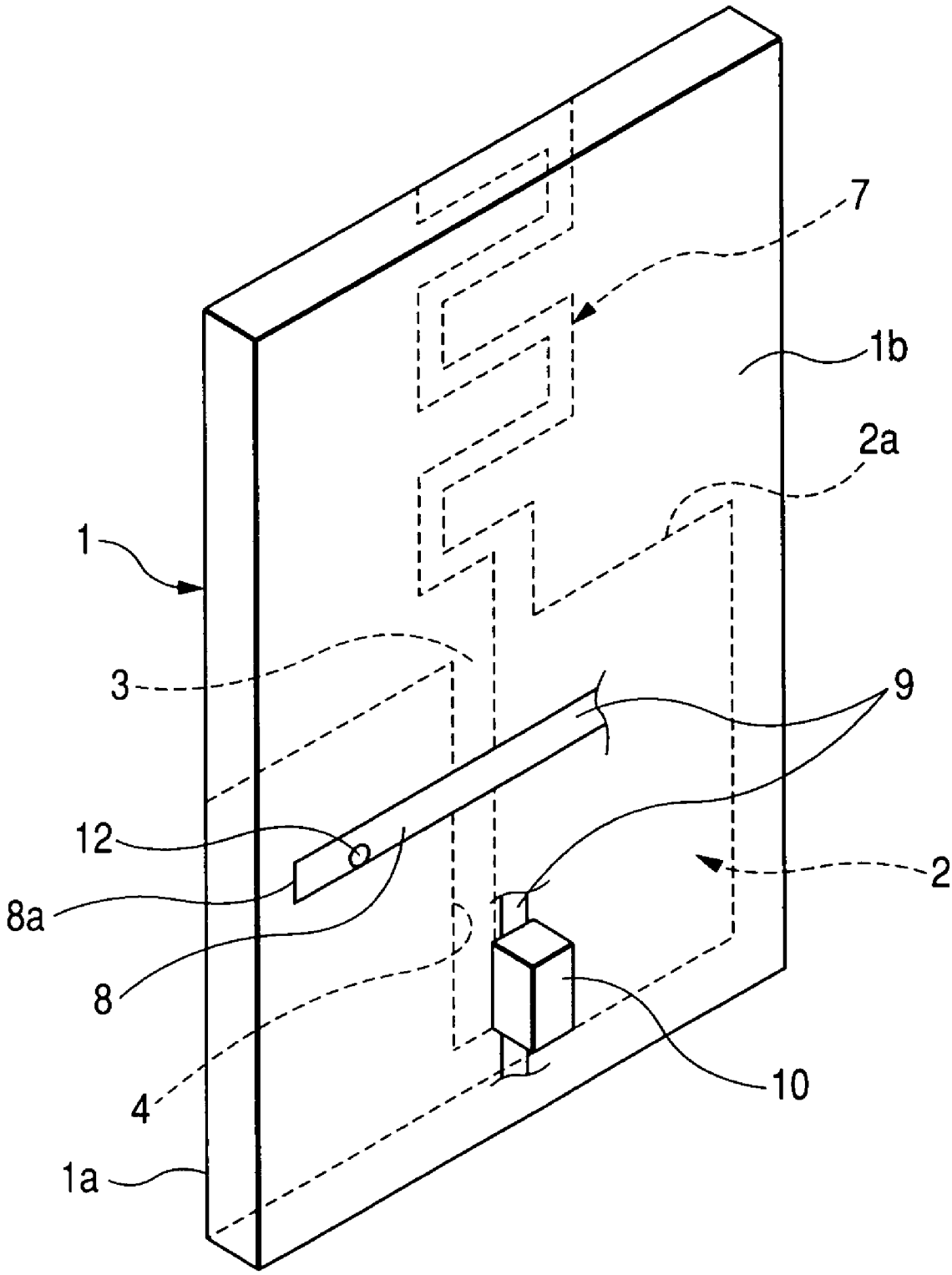
FIG. 5 is a perspective view illustrating an antenna device according to a fifth embodiment of the invention.
Figure 6:
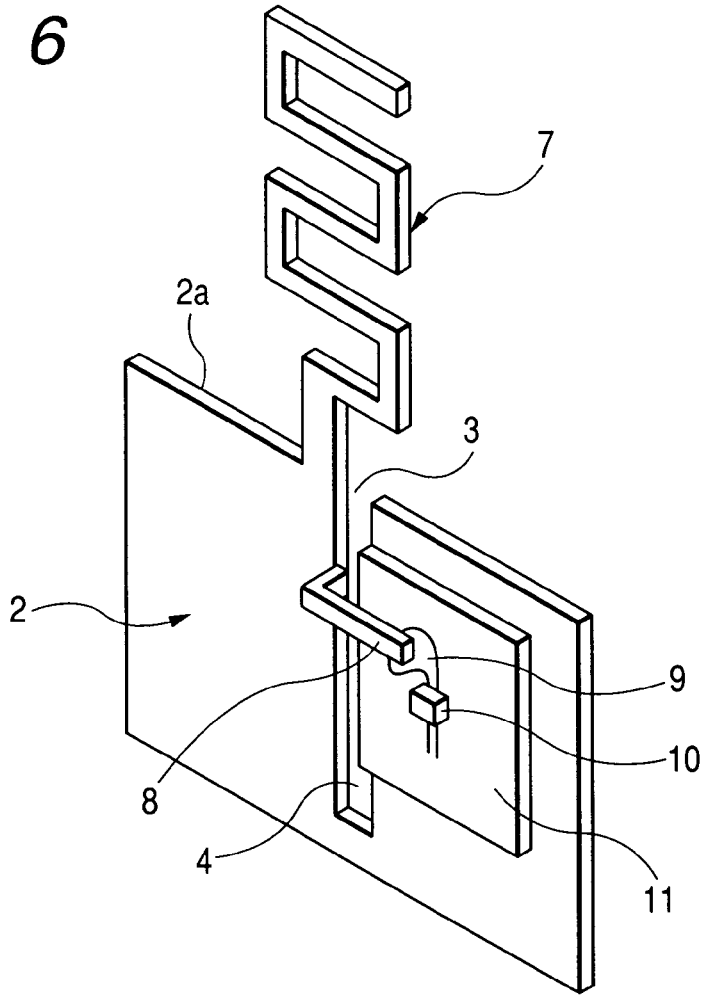
FIG. 6 is a perspective view illustrating an antenna device according to a sixth embodiment of the invention.
Figure 7:
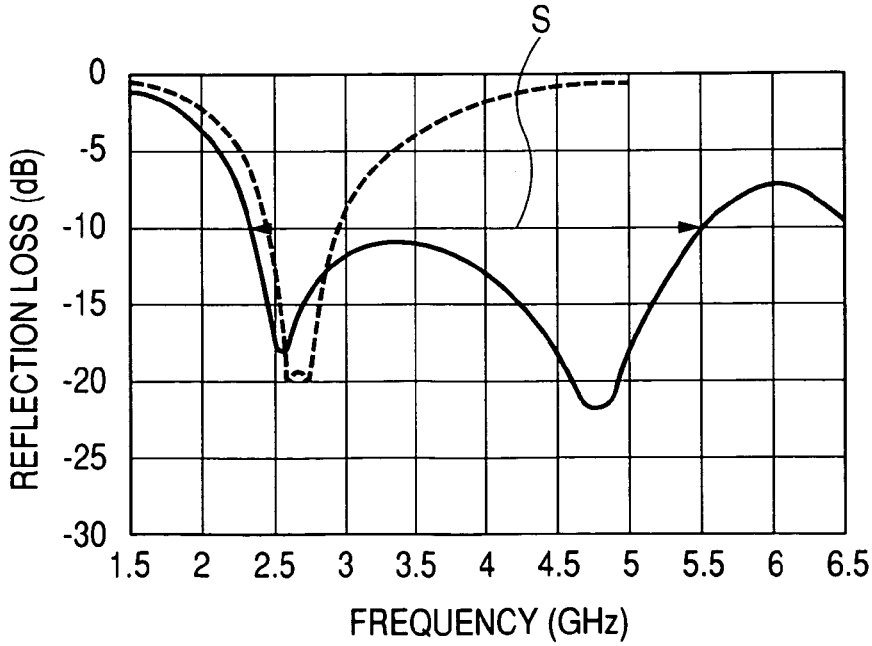
FIG. 7 is an explanatory view illustrating frequency characteristics of an antenna device.
Figure 8:
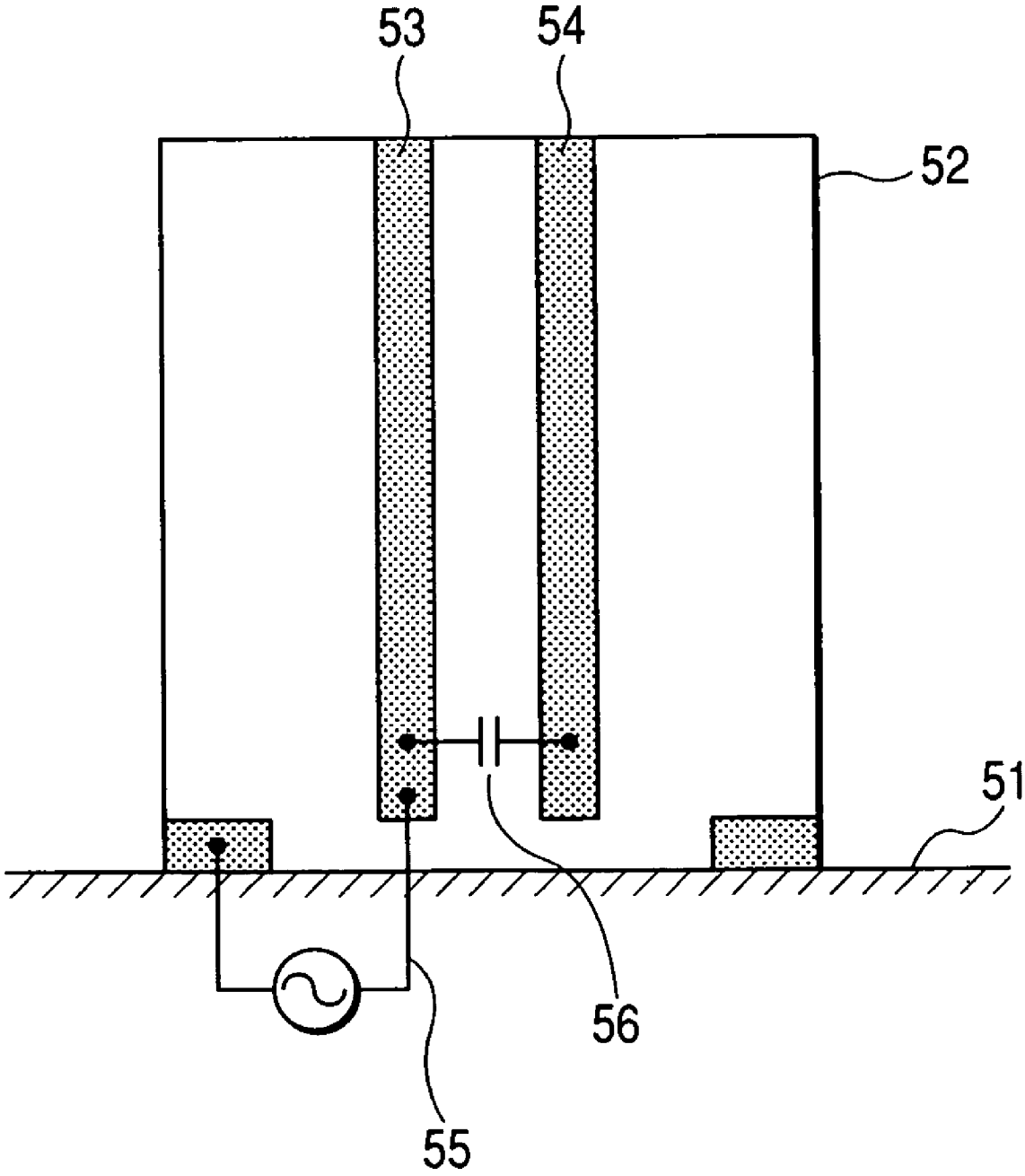
FIG. 8 PRIOR ART
FIG. 8 is a front view illustrating a conventional antenna device.

FIG. 1 is a perspective view illustrating an antenna device according to a first embodiment of the invention; FIG. 2 is a perspective view illustrating an antenna device according to a second embodiment of the invention; FIG. 3 is a perspective view illustrating an antenna device according to a third embodiment of the invention; FIG. 4 is a perspective view illustrating an antenna device according to a fourth embodiment of the invention; FIG. 5 is a perspective view illustrating an antenna device according to a fifth embodiment of the invention; FIG. 6 is a perspective view illustrating an antenna device according to a sixth embodiment of the invention; and FIG. 7 is an explanatory view illustrating frequency characteristics of an antenna device.

Referring to FIG. 1, an antenna device according to the first embodiment of the invention is configured such that a conductor 2 is provided on one surface 1*a* of a dielectric substrate 1 having a rectangular plate shape by forming a conductive pattern, the conductive pattern being formed by etching copper foil or by coating conductive paste or the like. Also, the conductor 2 is provided with a meandering radiating conductor 7 which extends outward from one end 2*a* of the conductor 2 and has a length corresponding to a quarter wavelength of a first frequency. In addition, the conductor 2 is provided with a strip-shaped slot portion 4 that is formed by removing the conductor 2 inward from an opening 3 provided at the one end 2*a* and has a length corresponding to a quarter wavelength of a second frequency.

Further, a feed portion 8 is disposed to be perpendicular to the slot portion 4 and cross over the slot portion 4. One end portion 8*a* of the feed portion 8 is connected to the conductor 2, and the other end portion 8*b* of the feed portion 8 does not electrically conduct with the conductor 2 and penetrates a through hole 1*c* of the dielectric substrate 1 so as to extend toward the other surface 1*b* of the dielectric substrate 1. As such, the antenna device according to the first embodiment of the invention is constructed.

In the embodiment, a case in which the feed portion 8 is disposed on the one surface 1*a* of the dielectric substrate 1 has been described, however, the feed portion 8 may be disposed to cross over the slot portion 4 from the side of the other surface 1*b* of the dielectric substrate 1.

In addition, even though the feed portion 8 is shown to be connected to the conductor 2 provided with the radiating conductor 7, the feed portion 8 may be connected to the other conductor 2 not provided with the radiating conductor 7.

When high frequency signals are fed to the other end portion 8*b* of the feed portion 8, an electric field caused by resonance is generated in the slot portion 4 in a direction perpendicular to the longitudinal direction of the slot portion 4, and thus electric waves having a polarization plane H1 parallel to the electric field are radiated.

Further, the high frequency signals are fed to the radiating conductor 7 through the conductor 2 and the radiating conductor 7 resonates as a monopole antenna in which the conductor 2 functions as a ground plane, and thus electric waves having a polarization plane H2 in a direction extending from the conductor 2 are radiated.

Since the polarization plane H1 radiating from the slot portion 4 and the polarization plane H2 radiating from the monopole radiating conductor 7 are perpendicular to each other, they are not coupled to each other. As a result, sufficient isolation characteristics can be obtained, so that it is possible to perform radiation in a wideband range.

When the radiation efficiency is measured as reflection loss versus frequency, the frequency band S at the reflection loss of −10 dB is from 2.3 GHz to 5.5 GHz, as shown by a solid line in FIG. 7. Accordingly, it is possible to achieve six times wider frequency band than that in the related art.

Next, FIG. 2 illustrates an antenna device according to the second embodiment of the invention. In the antenna device according to the second embodiment of the invention, a dielectric substrate 1 is formed by using a flexible substrate which can be bent. The dielectric substrate 1 is bent at a boundary between a conductor 2 and a radiating conductor 7 at a right angle, and the radiating conductor 7 is formed by using a strip-shaped conductor.

Other configurations are the same as those in the first embodiment described above, and the same components are denoted by the same reference numerals and thus detailed explanation thereof will be omitted.

Even in the second embodiment, the directions of the polarization planes H1 and H2 of the slot portion 4 and the radiating conductor 7 are perpendicular to each other.

Further, FIG. 3 illustrates an antenna device according to the third embodiment of the invention. In the antenna device according to the third embodiment of the invention, the dielectric substrate 1 is not provided, a conductor 2 and a radiating conductor 7 are formed by performing a pressing process for one metal plate, and a feed portion 8 is provided as a separate component.

Other configurations are the same as those in the first embodiment described above, and the same components are denoted by the same reference numerals and thus detailed explanation thereof will be omitted.

In the antenna device according to the third embodiment described above, the radiating conductor 7 has a meandering shape; however, as shown in FIG. 2, the radiating conductor 7 may be a strip-shaped conductor and may be bent at the end portion 2*a* of the conductor 2.

Further, the radiating conductor 7 may be bent along the longitudinal direction of the slot portion 4 with the end portion 2*a* of the conductor 2 as a reference line in a state in which the radiating conductor 7 and the conductor 2 are on the same plane, and thus the radiating conductor 7 may be disposed within a range of about 180° which is an angle closest to the conductor 2.

Furthermore, FIG. 4 illustrates an antenna device according to the fourth embodiment of the invention. In the antenna device according to the fourth embodiment of the invention, a feed portion 8 is integrally formed by bending one metal plate, with a conductor 2 and a radiating conductor 7, and the feed portion 8 is disposed to cross over a slot portion 4.

Other configurations are the same as those in the third embodiment described above, and the same components are denoted by the same reference numerals and thus detailed explanation thereof will be omitted.

In the antenna device according to the fourth embodiment described above, the radiating conductor 7 has a meandering shape; however, as shown in FIG. 2, the radiating conductor 7 may be a strip-shaped conductor and may be bent at the end portion 2*a* of the conductor 2.

In addition, FIG. 5 illustrates an antenna device according to the fifth embodiment of the invention. In the antenna device according to the fifth embodiment of the invention, an amplifying circuit (not shown), a filter circuit (not shown), and the like are formed on the other surface 1*b* of the dielectric substrate 1 by using an electronic component 10 or the like, a wiring pattern 9 connected to those circuits is provided, a feed portion 8 is formed by extending the wiring pattern 9 so as to be perpendicular to a slot portion 4 and cross over the slot portion 4, and one end 8*a* of the feed portion 8 is connected to the conductor 2 provided on the one surface 1*a* through a through hole (connecting conductor) 12.

Other configurations are the same as those in the first embodiment described above, and the same components are denoted by the same reference numerals and thus detailed explanation thereof will be omitted.

Further, FIG. 6 illustrates an antenna device according to the sixth embodiment of the invention. In the antenna device according to the sixth embodiment of the invention, an amplifying circuit (not shown), a filter circuit (not shown), and the like are formed on a circuit board 11 disposed on a surface of a plate-shaped conductor 2, and a wiring pattern 9 connected to those circuits is connected with a feed portion 8 by a soldering operation. Other configurations are the same as those in the fourth embodiment described above, and the same components are denoted by the same reference numerals and thus detailed explanation thereof will be omitted.

According to the embodiments of the invention, the antenna device includes the plate-shaped conductor; the radiating conductor that extends outward from the end portion of the conductor and has a length corresponding to a quarter wavelength of a first frequency; the strip-shaped slot portion that is formed by removing a part of the conductor extending inward from the vicinity of the end portion from which the radiating conductor extends and has a length corresponding to a quarter wavelength of a second frequency, the second frequency being different from the first frequency; and the feed portion that is disposed to be perpendicular to the slot portion and to cross over the slot portion and that feeds the same signals to the slot portion and the radiating conductor, and the polarization plane of the radiating electric field radiating from the radiating conductor and the polarization plane of the radiating electric field radiating from the slot portion are disposed to be perpendicular to each other.

That is, since the polarization plane of the radiating electric field radiating from the radiating conductor and the polarization plane of the radiating electric field radiating from the slot portion are disposed to be perpendicular to each other, it is possible to achieve six times wider frequency band than that in the related art, which provides the radiation characteristics suitable for being used for the ultrawideband communications. Also, since one-point feeding structure is realized with respect to two radiating conductors, it is possible to obtain a low-priced antenna device.

Further, since the radiating conductor is formed in a meandering shape, it is possible to make the length extending outward from the conductor short, which allows a reduced sized antenna device.

Furthermore, since the radiating conductor is bent along the longitudinal direction of the slot portion with the end portion of the conductor as a reference line in a state in which the radiating conductor and the conductor are on the same plane and the radiating conductor is disposed between the conductor and the location closest to the conductor, it is possible to dispose the polarization plane of the electric waves radiating from the radiating conductor and the polarization plane of the electric waves radiating from the slot portion to be perpendicular to each other in a simple structure.

Furthermore, since the radiating conductor extends from the conductor on the same plane as the conductor, it is possible to realize a thin antenna device.

Furthermore, since the radiating conductor is disposed vertically with respect to the conductor, it is possible to make the length extending outward from the conductor short, which allows an even more reduced sized antenna device.

Furthermore, since the conductor and the radiating conductor are formed by using one metal plate, a material cost is low, and accordingly, it is possible to obtain a low-priced antenna device.

Furthermore, since the feed portion is formed by using the one metal plate formed with the conductor and the radiating conductor, the material cost is even lower, and accordingly, it is possible to obtain a low-priced antenna device.

Furthermore, since the plate-shaped conductor is mounted with the circuit board formed with at least the amplifying circuit, one end of the feed portion is connected to the amplifying circuit, and the other end of the feed portion is connected to the conductor in the vicinity of the slot portion, the distance between the feed portion and the amplifying circuit becomes short. As a result, the antenna device is little affected by external noise.

Furthermore, since the dielectric substrate one surface of which being formed with a conductive pattern is further included and the conductor and the radiating conductor are formed by the conductive pattern, it is possible to make the antenna device smaller due to the wavelength shortening effect of the dielectric substrate.

Furthermore, since the dielectric substrate is formed by using a flexible substrate that can be bent, in a case in which the antenna device is built in a small electronic apparatus, by bending the dielectric substrate, the degree of freedom for the disposition increases.

Furthermore, the wiring pattern and at least the amplifying circuit are provided at the other surface side of the dielectric substrate, the feed portion is formed by the wiring pattern, and one end of the feed portion is connected to the amplifying circuit and the other end of the feed portion is connected to the conductor through a through hole, so that it is possible to make wiring lines by using the wiring pattern formed on the dielectric substrate. As a result, the number of fabrication processes is reduced, and thus a low-priced antenna device can be obtained.

Furthermore, since the first frequency radiating from the radiating conductor is set to be lower than the second frequency radiating from the slot portion, the length extending from the conductor becomes short due to the meandering shape, which allows a reduced sized antenna device.

The invention claimed is:

1. An antenna device comprising:

a plate-shaped conductor;

a radiating conductor that extends outward from an end portion of the plate-shaped conductor and has a length corresponding to a quarter wavelength of a first frequency;

a strip-shaped slot portion that is formed by removing a part of the plate-shaped conductor extending inward from the vicinity of the end portion from which the radiating conductor extends and has a length corresponding to a quarter wavelength of a second frequency, the second frequency being different from the first frequency; and a feed portion that is disposed to be perpendicular to the slot portion and to cross over the slot portion and that feeds the same signals to the slot portion and the radiating conductor, wherein a polarization plane of a radiating electric field radiating from the radiating conductor and a polarization plane of a radiating electric field radiating from the slot portion are disposed to be perpendicular to each other.

2. The antenna device according to claim 1, wherein the radiating conductor is formed in a meandering shape.

3. The antenna device according to claim 2, wherein the first frequency radiating from the radiating conductor is lower than the second frequency radiating from the slot portion.

4. The antenna device according to claim 1, wherein the radiating conductor is bent along a longitudinal direction of the slot portion with the end portion of the plate-shaped conductor as a reference line in a state in which the radiating conductor and the plate-shaped conductor are on the same plane, and the radiating conductor is disposed between the plate-shaped conductor and a location closest to the plate-shaped conductor.

5. The antenna device according to claim 4, wherein the radiating conductor extends from the plate-shaped conductor on the same plane as the plate-shaped conductor.

6. The antenna device according to claim 4, wherein the radiating conductor is disposed vertically with respect to the plate-shaped conductor.

7. The antenna device according to claim 1, wherein the plate-shaped conductor and the radiating conductor are formed by using one metal plate.

8. The antenna device according to claim 7, wherein the feed portion is formed by using the one metal plate formed with the plate-shaped conductor and the radiating conductor.

9. The antenna device according to claim 7, wherein the plate-shaped conductor is mounted with a circuit board formed with at least an amplifying circuit, one end of the feed portion is connected to the amplifying circuit, and another end of the feed portion is connected to the plate-shaped conductor in the vicinity of the slot portion.

10. The antenna device according to claim 1, further comprising:

a dielectric substrate, one surface of which being formed with a conductive pattern, wherein the plate-shaped conductor and the radiating conductor are formed by the conductive pattern.

11. The antenna device according to claim 10, wherein the dielectric substrate is formed by using a flexible substrate that can be bent.

12. The antenna device according to claim 10, wherein a wiring pattern and at least an amplifying circuit are provided at an opposing surface side of the dielectric substrate, the feed portion is formed by the wiring pattern, and one end of the feed portion is connected to the amplifying circuit and another end of the feed portion is connected to the plate-shaped conductor through a through hole.

* * * * *